United States Patent [19]

Fini

[11] Patent Number: 4,998,230

[45] Date of Patent: Mar. 5, 1991

[54] TIMEPIECE WITH MECHANISM FOR INDICATING THE TIME OF DIFFERENT TIME ZONES

[76] Inventor: Giuseppe Fini, Via S. Stefano 58/2, 40125 Bologna, Italy

[21] Appl. No.: 531,272

[22] Filed: May 31, 1990

[30] Foreign Application Priority Data

Dec. 28, 1987 [IT] Italy ..... 5023/87[U]

[51] Int. Cl.[5] ..... G04B 19/22

[52] U.S. Cl. ..... 368/27

[58] Field of Search ..... 368/21, 22, 27, 76, 368/77, 220, 221, 233

[56] References Cited

U.S. PATENT DOCUMENTS

| | | | |
|---|---|---|---|
| 3,075,411 | 7/1972 | Sakuma | 368/27 |
| 3,703,805 | 11/1972 | Ganter et al. | 368/21 |
| 3,871,169 | 3/1975 | Schwaar et al. | 368/27 |
| 4,634,287 | 1/1987 | Vuilleumier et al. | 368/27 |
| 4,945,521 | 7/1990 | Klaus | 368/21 |

*Primary Examiner*—Vit W. Miska

*Attorney, Agent, or Firm*—Guido Modiano; Albert Josif

[57] ABSTRACT

A timepiece having a pivot supporting an hour hand, a coaxial shaft supporting a minute hand and a dial, having hour and minute indicia and openings corresponding to time zones. A gearwheel having a number of teeth corresponding to the number of time zones, is supported on the pivot and bears a disk having time-zone indicia. A first elastic element biases a radially movable body towards the gearwheel. A cam acts on the body every hour to move it against the biasing action of the first elastic element to a disengagement position, whereat the first elastic element causes a snap-action movement of the body towards the gearwheel. A pawl pivoted to the body is radially aligned with a tooth space of the gearwheel by a second elastic element. The resultant rotational traction of the gearwheel corresponds to a one-hour movement of the disk and the time zone indicia.

3 Claims, 2 Drawing Sheets

TIMEPIECE WITH MECHANISM FOR INDICATING THE TIME OF DIFFERENT TIME ZONES

BACKGROUND OF THE INVENTION

The present invention relates to an improved timepiece with mechanism for indicating the time of different time zones.

It is known that the time in regions located in different time zones is currently ascertained with timepieces known as "meridians" which comprise a dial with the indication of the local minutes and hours, whereas the time corresponding to the different time zones appears on the dial through openings or windows provided therein and labeled with signs indicating the time zone and/or with names of cities located in the related time zone. The signs indicating the hours of the time zones are defined on a disk which is below the dial and rotates by one step every hour.

The advancement of said disk is manual or automatic. It has been observed that in timepieces with automatic advancement, for example of the type described in U.S. Pat. No. 3,702,056, the time zone hour change step lasts even as much as a few minutes, so that during the change of the time zone hour it is not possible to read any digit and therefore know the hour of the time zone. In conventional automatic timepieces, considerable power is furthermore required by the actuation elements, so that the autonomy of the timepiece is reduced substantially.

In order to obviate the above-mentioned shortcomings the applicant, together with the coinventor Armando Zoli, now deceased, disclosed in the Italian Utility Model Patent No. 212,264 a timepiece with indication of the time in different time zones having reduced energy requirements with respect to traditional timepieces of this type.

SUMMARY OF THE INVENTION

The technical aim of the present invention is to provide improvements in a timepiece of the type described in the Italian Utility Model Patent No. 212,264, which allows to minimize the duration of the changeover of the time zone hour so as to achieve a further reduction in energy requirements.

Within the scope of this aim, an object of the present invention is to provide a timepiece which is structurally simple and therefore economical to manufacture in relation to the better performance it can provide and is, nevertheless, highly reliable in operation.

This aim and this object are obtained by a timepiece provided with means for indicating the time of different time zones, comprising a dial bearing indications of hours and minutes and having a plurality of openings angularly spaced-apart by identical angles and provided along a circumference, at a center whereof is the axis of hour and minute hands, a gearwheel having a number of teeth corresponding to the number of time zones and being rotatably supported about said axis, a spring for elastic retention of said gearwheel, a disk coaxially rigidly associated with said gearwheel below said dial and having indicia corresponding to time zones which is visible through said openings, an arcuate spring having a fixed end and a free end defining an enlarged portion, a hammer-like element pivotally connected to said enlarged portion and defining a point normally engaged between the teeth of said toothed wheel, a pawl keyed to a rotatable shaft and acting every hour on said portion, thereby radially moving said portion, against biasing action of said spring, to a release position, whereat said spring causes a snap-action movement of said body toward said gearwheel, elastic means for acting on said hammer-like element returning said pawl to a position in which said point is radially aligned with a tooth space of said gearwheel when said body has reached said release position, said snap-action movement causing the engagement of said point in said tooth space, the rotation of said hammer-like element against said elastic means and the rotational traction of the gearwheel corresponding to a one-hour movement of the time zone disk.

BRIEF DESCRIPTION OF THE DRAWINGS

Further advantages and characteristics of the present invention will become apparent from the following description of an embodiment illustrated only by way of non-limitative example in the accompanying drawings, wherein.

DESCRIPTION OF THE PREFERRED EMBODIMENTS

Figure 1:
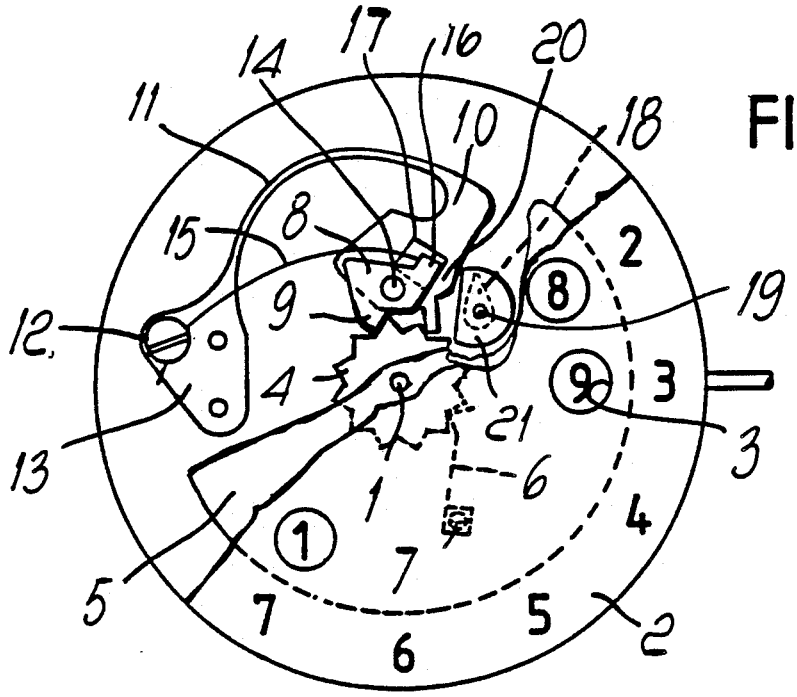
FIG. 1 is a schematic front view of the timepiece according to the invention in an idle position, with the dial and the time-zone disk shown in cross section to allow viewing of the underlying elements.

With reference to the above figures, the timepiece according to the invention comprises a central pivot 1 on which the hour hand is fixed and on which the shaft which supports the minute hand rotates coaxially thereto. The hands (not illustrated) move above the dial 2 and the indications of hours and minutes are provided peripherally to said dial.

Any conventional means may be provided for generating motion of the central pivot and shaft, such as mechanical or clockwork means, electrically powered means, automatic winding mechanisms etc.

A plurality of openings or windows 3, arranged along a circumference which is concentric to the pivot 1, is provided on the dial 2; said openings are internal with respect to the indications of hours and minutes.

A gearwheel 4 is rotatably supported on the pivot 1, whereon a disk 5 is fixed, peripherally provided with numbering from 1 to 12 which corresponds to the indicia shown on the dial and indicates the hour of the time zones.

The gearwheel 4 comprises twelve teeth wherebetween the appropriately shaped end of a spring 6 engages; said spring is fixed by means of a screw 7. The spring 6 keeps the gearwheel 4 elastically in a retained position in which the hour of the time zones appear through the windows 3. A hammer-like element 8, consisting of a plate which has, on one side, a point 9 adapted to engage between the teeth of the gearwheel 4, co-operates with said gearwheel 4.

The hammer-like element 8 is pivoted on an enlarged portion 10 which is shaped at the end of an arcuate spring 11 which is fixed by means of a screw 12 inserted into the end 13 of said spring.

The fulcrum of the hammer-like element 8 in the body 10 is indicated by the reference number 14 and is placed so that by tracing an ideal connecting line between the fulcrum 14 and the pivot 1, the point 9 remains to the left of said line (FIG. 1), when in a position of engagement between the teeth of the toothed wheel 4.

Figure 3:
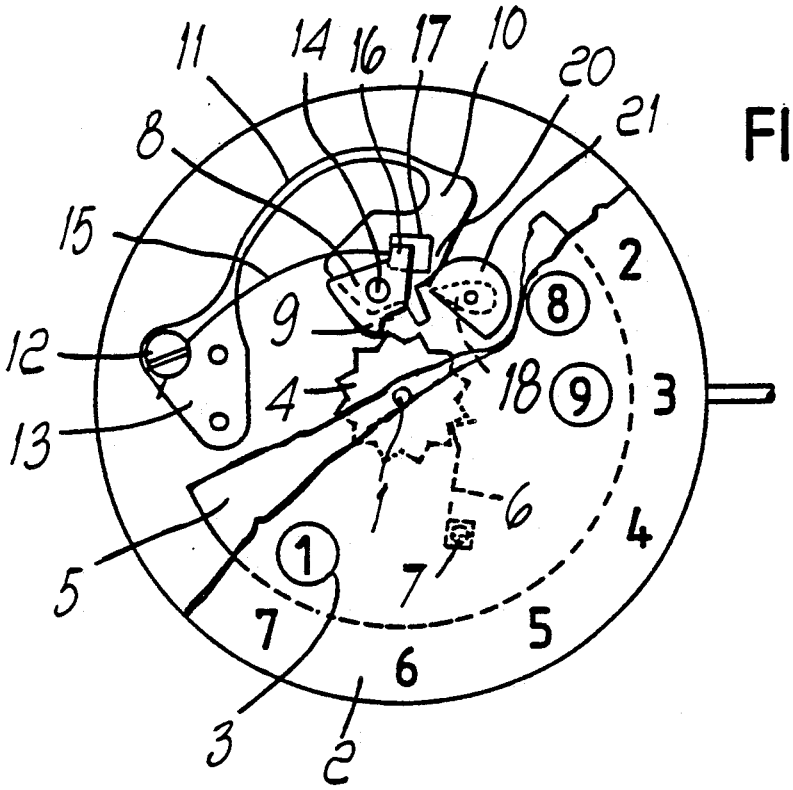

The hammer-like element 8 is stressed in engagement position between the teeth of the wheel 4 by a spring 15 which is welded, at one end, to the hammer-like element 8 at a tab 16 which is diametrically opposite to the point 9 with respect to the fulcrum 14, and rests on the screw 12 at its other end. When the hammer-like element 8 is disengaged from the gearwheel 4 (position of FIGS. 3 and 4), and spring 15 imparts rotation to the hammer-like element 8 which causes the latter to abut, with the appropriately folded tab 16, against the inner edge of a slot 17 formed in the portion 10. In this position, the point 9 moves in opposition to a tooth space which is adjacent to the one which had been engaged previously.

The described timepiece is completed by a rotating element 18 constituted by an arm or pawl keyed to a small shaft 19 which is connected to the movement of the timepiece so as to rotate through one revolution every hour. The pawl 18 is arranged bedside the portion 10, so that during rotation it may come into contact with a corner or abutment 20 of the portion so as to determine a substantially radial spacing of the portion 10 with respect to the pivot 1. Advantageously, the pawl 18 is covered by a flange 21, rigidly associated with the shaft 19.

The operation of the described timepiece is as follows. In normal conditions, the timepiece is a shown in FIG. 1, with the point 9 of the hammer-like element 8 engaged between the teeth of the gearwheel 4 which is prevented from rotating by the spring 6.

Figure 2:
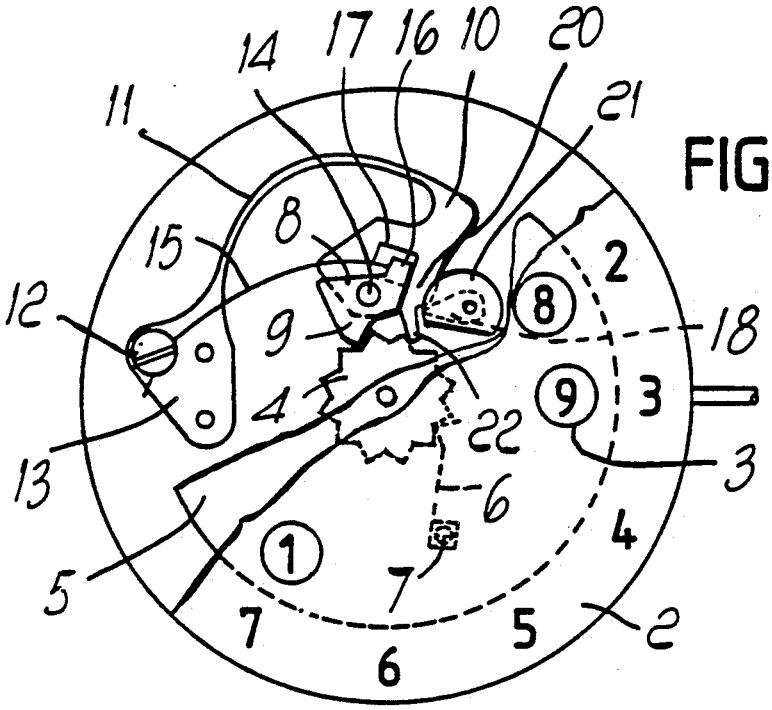
FIGS. 2, 3 and 4 are views of the timepiece of FIG. 1 in three successive operative positions during the time zone hour changeover.

Toward the end of each hour, the pawl 18 starts to act against the corner 20 of the portion 10, which is moved radially outward by virtue of the gradual rotation of the pawl 18. During this step, shown in FIGS. 2 and 3, the point 9 remains at rest on a side of the tooth arranged on one side (i.e., to the right in FIGS. 2 and 3) with respect to said point.

Figure 4:
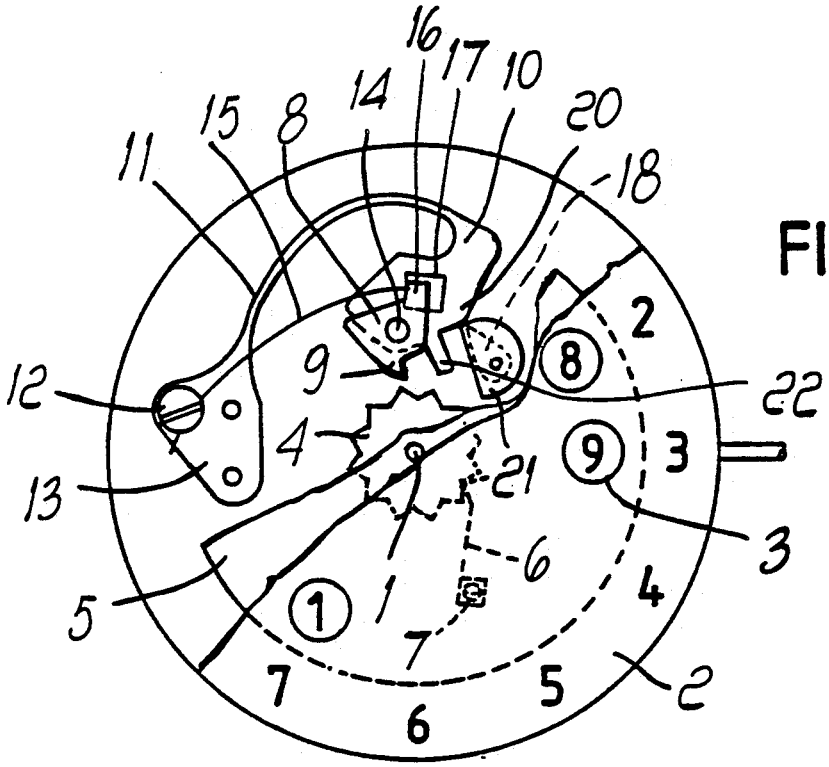

The radial spacing of the portion 10 continues until the point 9 passes beyond the rightward tooth and the hammer-like element 8, and by virtue of the biasing action of the spring 15, performs an oscillation which stops due to the abutment of the tab 16 against the inner edge of the slot 17. In this position, as mentioned above, the point 9 is aligned with the adjacent tooth space (FIG. 4).

When the end of the pawl 18 has passed the corner 20 of the portion 10, by virtue of the biasing action of the spring 11, it is rapidly pushed back toward the gearwheel 4, causing the engagement of the point 9 in the adjacent tooth space and the snap-action counterclockwise rotation of the gearwheel 4. The end of the spring 6 simultaneously jumps into the subsequent tooth space of the gearwheel 4, retaining the disk 5 in the new position which corresponds to the advancement by a step equal to one hour of the time zones visible through the windows 3. The cycle then repeats every hour in the above described manner.

As can be seen, the invention fully achieves the proposed aim and objects. In particular, it should be noted that the rotation time of the disk 5 is virtually instantaneous and that the instant in which the changeover occurs can be easily corrected by acting on the angular position of the pawl 18. Furthermore, the energy requirement is significantly reduced, since the kinetic energy imparted to the hammer-like element 8 by the progressively loaded spring 11 is used.

Advantageously, in order to prevent the gearwheel 4 and the disk 5 from advancing by two teeth after the action of the hammer-like element 8 once the portion 10 has passed beyond the end of the pawl 18, a tooth 22 (FIG. 2) conveniently provided on the edge of the portion 10, is directed toward the gearwheel 4 and, by wedging between the teeth of said gearwheel 4 during the movement of the portion 10, prevents double advancement of the wheel 4 and the disk 5.

Advantageously, the flange 21 ensures that the pawl 18 remains in engagement with the corner 20 even when, due to the elastic biasing action which causes the pawl to act against the portion 10, the contacting edges become bevelled or rounded through wear, thereby favoring overlapping.

The invention thus conceived is susceptible to numerous modifications and variations, all of which are within the scope of the inventive concept.

All the details may furthermore be replaced with ther technically equivalent elements.

In practice, the materials employed, so long as compatible with specific use, as well as the contingent shapes and dimensions, may be any according to the requirements.

I claim:

1. Timepiece with mechanism for indicating the time of different time zones, comprising a dial bearing indications of hours and minutes and having a plurality of openings angularly spaced-apart by identical angles and provided along a circumference, at the center whereof is located an hour and minute hand axis, a gearwheel having a number of teeth corresponding to a number of time zones and being rotatably supported about said axis, spring means for the elastic retention of said gearwheel, a disk coaxially rigidly associated with said gearwheel below said dial and bearing indicia, corresponding to the time zones and being visible through said openings, an arcuate spring having a fixed end and a free end defining an enlarged portion, a hammer-like element pivotally connected to said enlarged portion and defining a point normally engaged between the teeth of said toothed wheel, a pawl keyed to a rotatable shaft and acting every hour on said portion, thereby moving said portion, against biasing action of said spring, to a disengagement position at which said spring causes a snap-action movement of said body toward said gearwheel, elastic means acting on said hammer-like element for returning said pawl to a position in which said point is radially aligned with a tooth space of said gearwheel when said portion has reached said disengagement position, said snap-action movement causing the engagement of said point in said tooth space, rotation of said hammer-like element against said elastic means and rotational traction of said gearwheel corresponding to a one-hour movement of said disk.

2. Timepiece according to claim 1, wherein said hammer-like element, has at one side thereof a point adapted for insertion between the teeth of the toothed wheel and has at another side thereof, which is diametrically opposite with respect to the fulcrum of said enlarged portion of said spring, a tab engaged in a slot of said enlarged portion, said elastic means comprising a spring being rigidly associated with said hammer-like element and maintaining said tab, when said enlarged portion assumes said disengagement position, at an abutment position on an inner edge of said slot whereat said point is aligned with a tooth space adjacent the previously engaged space.

3. Timepiece according to claim 1, further comprising a flange keyed to said shaft adjacent said pawl which extends to cover the zone of engagement between said pawl and a corner of said enlarged portion.

* * * * *